US007048586B2

(12) United States Patent
Ishizaki et al.

(10) Patent No.: US 7,048,586 B2
(45) Date of Patent: May 23, 2006

(54) SHIELD CONNECTOR

(75) Inventors: Kazuhisa Ishizaki, Haibara-gun (JP); Eiji Aoki, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/185,865

(22) Filed: Jul. 21, 2005

(65) Prior Publication Data

US 2006/0019539 A1 Jan. 26, 2006

(30) Foreign Application Priority Data

Jul. 22, 2004 (JP) ..... P2004-213990

(51) Int. Cl.
*H01R 9/03* (2006.01)

(52) U.S. Cl. ..... 439/610; 439/108; 439/98

(58) Field of Classification Search ..... 439/610, 439/98, 108

See application file for complete search history.

(56) References Cited

U.S. PATENT DOCUMENTS 3,999,830 A * 12/1976 Herrmann et al. ..... 439/610
5,691,506 A * 11/1997 Miyazaki et al. ..... 174/65 R
6,612,870 B1 * 9/2003 Rauscent ..... 439/610
6,793,532 B1 * 9/2004 Saito et al. ..... 439/610
6,796,838 B1 * 9/2004 Yoshioka ..... 439/607

* cited by examiner

*Primary Examiner*—Truc Nguyen

(74) *Attorney, Agent, or Firm*—Sughrue Mion, PLLC

(57) ABSTRACT

Each of shielding terminals is made of an electrically-conductive material, and includes a plate-shaped conducting plate portion, and a shielding shell of a tubular shape which is formed in an upstanding manner on the conducting plate portion, and is electrically connected to an electrically-conductive shielding member of a corresponding shielded wire. The conducting plate portions of the shielding terminals are held between a holder plate and an outer surface of a connector housing, and are disposed on the outer surface of the connector housing. These conducting plate portions are fixed to the connector housing by bolts and. The conducting plate portions are held in surface-to-surface contact with the outer surface of the connector housing.

4 Claims, 11 Drawing Sheets

SHIELD CONNECTOR

BACKGROUND OF THE INVENTION

This invention relates to a shield connector, and more particularly to a shield connector in which the ability of contact between a shielding terminal and a connector housing is enhanced so as to positively achieve the shielding in a stable manner.

In a related shield connector, a connector housing which is made of an electrically-conductive material (such as aluminum) is used, and a shielding terminal, connected to an electrically-conductive shielding member, is disposed to be electrically connected to the connector housing, thereby shielding a connector portion. FIGS. 9 to 11 show a well-known shield connector. FIG. 9 is a perspective view of the shield connector, showing its appearance, FIG. 10 is a vertical cross-sectional view taken along the line X—X of FIG. 9, and FIG. 11 is an enlarged view of a portion encircled by a circle X1 of FIG. 10.

As shown in FIGS. 9 to 11, the shield connector 1 includes a connector housing 9, and this connector housing 9 includes a connector housing base 3 made of an electrically-conductive material such as aluminum, and a housing 5 made of an insulative material such as a synthetic resin. The connector housing base 3 and the housing 5 are fixed to each other by bolts 7.

A shielding terminal 11 is formed of a thin plate or sheet made of an electrically-conductive material such as copper, and this shielding terminal 11 includes a conducting plate portion 11*a* having plate shape, and shielding shells 11*b* of a generally cylindrical shape formed on and projecting upwardly from the conducting plate portion 11*a*. The conducting plate portion 11*a* is held between the connector housing base 3 and the housing 5. A collar 21 is fitted in each of bolt holes 5*b* formed in the housing 5, and the bolts 7 are passed respectively through the collars 21, and fasten the connector housing base 3 and the housing 5 together. The shielding shells 11*b* are fitted respectively in connector chambers 5*a* of the housing 5.

Ring-shaped convex contact portions 11*c* of a generally inverted V-shaped cross-section are formed on the conducting plate portion 11*a*, and are disposed respectively around through holes (each for the passage of the bolt 7) formed through the conducting plate portion 11*a* (see FIG. 11). An end surface of each collar 21 abuts against the corresponding convex contact portion 11*c*. A plurality of resilient contact piece portions 11*d* are formed at one end portion (upper end portion in FIG. 10) of the shielding shell 11*b*, fitted in the connector chamber 5*a*, which is to be disposed close to a mating connector, the resilient contact piece portions 11*d* being formed by stamping relevant portions of the one end portion and then by bending these portions inwardly into a curved shape.

An inner housing 15 receives and holds shielded wires (or cables) 13 each having a conductor (also called "core wire") 13*a* exposed within the inner housing 15. The inner housing 15 is fitted in those portions of the shielding shells 11*b* disposed close to the conducting plate portion 11*a*. The inner housing 15 passes through through holes 3*a* in the connector housing base 3, and is fitted in the connector chambers 5*a* of the housing 5. Male pin terminals 22 are electrically connected at their one ends respectively to the conductors 3*a* of the shielded wires 3, and are disposed coaxially with the shielding shells 11*b*, respectively.

As shown in FIG. 11, the conducting plate portion 11*a* of the shielding terminal 11 is held between the connector housing base 3 and the collars 21 (and also the housing 5), and when the conducting plate portion 11*a* is fixed to the housing 5 by the bolts 7, the convex contact portions 11*c* are pressed by the collars 21, respectively, so that the conducting plate portion 11*a* is held in contact with a surface 3*b* of the connector housing base 3. As a result, the shielding terminal 11 is electrically connected to the connector housing base 3, thereby achieving the shielding.

In the above related shield connector 1, the thin-plate shaped conducting plate portion 11*a* of the shielding terminal 11 is held in contact with the surface 3*b* of the connector housing base 3 by tightening the bolts 7, and therefore tightening loads, applied respectively from the bolts 7, concentrate on those portions of the conducting plate portion 11*a* positioned near respectively to the bolts 7. Therefore, only those portions of the conducting plate portion 11*a*, positioned respectively around the bolts 7, are held in contact with the connector housing base 3, and there is a possibility that at the other regions remote from the bolts 7, a gap is formed between the surface 3*b* of the connector housing base 3 and the conducting plate portion 11*a* of the shielding terminal 11. Therefore, the effective contact area that has a small electrical contact resistance is limited to the vicinities of the bolts 7, and there is a possibility that the effective contact area is inadequate, so that the shielding performance is insufficient. Even if the bolts 7 are directly passed respectively through the bolt holes 5*b* in the housing 5 without the use of the collars 21, and the conducting plate portion 11*a* is pressed against the connector housing base 3 through the housing 5, there is a possibility that a gap is formed between the surface 3*b* of the connector housing base 3 and the conducting plate portion 11*a* at the regions remote from the bolts 7, since the synthetic resin-made housing 5 has a relatively low mechanical strength. Thus, as is the case where the collars 21 are used, there is still the possibility that the sufficient effective contact area is not secured.

SUMMARY OF THE INVENTION

This invention has been made in view of the above circumstances, and an object of the invention is to provide a shield connector in which an effective area of contact between a shielding terminal and a connector housing is increased to thereby enhance the ability of contact therebetween so that the shield connector can have a stable shielding performance.

In order to accomplish the above object, a shield connector of the present invention is characterized by having the following arrangement, (1) A shield connector comprising:

a conductive connector housing;

a shielded wire extended from the connector housing and comprising:

a conductor adapted to be electrically connected to a mating terminal;

an insulative sheath covering the conductor; and a conductive shielding member covering the sheath;

a conductive shielding terminal comprising:

a first plate disposed on the connector housing and having a first through hole through which the shielded wire passes and a contact portion which is in contact with the shielding member;

a conductive second plate having a second through hole through which the shielded wire passes; and a plurality of fixing members fixing the first plate and the second plate on the connector housing, such that the first plate is pressed by the second plate against the connector housing.

(2) A shield connector according to (1), wherein the first plate has a first stiffness, and the second plate has a second stiffness that is lager than the first stiffness.

(3) A shield connector according to (2), wherein the first plate has a first thickness, and the second plate has a second thickness that is lager than the first thickness.

(4) A shield connector according to (1), wherein the contact portion has a tubular shape surrounding the shielding member.

According to the present invention, the first plate is pressed against the connector housing by the second plate having a high mechanical strength, and therefore is positively held in surface-to-surface contact with the connector housing, so that an effective area of contact between the first plate and the connector housing increases. Therefore, the contacting ability of the shielding terminal is enhanced, so that the shielding member of the shielded wire is positively electrically connected to the connector housing, and a conductor of the shielded wire is positively shielded from external noises.

According to the present invention, the effective area of contact between the shielding terminal and the connector housing increases, so that the shield connector can have the stable shielding performance.

DETAIL DESCRIPTION OF PREFERRED EMBODIMENT

One preferred embodiment of the present invention will now be described in detail with reference to the drawings.

Figure 1:
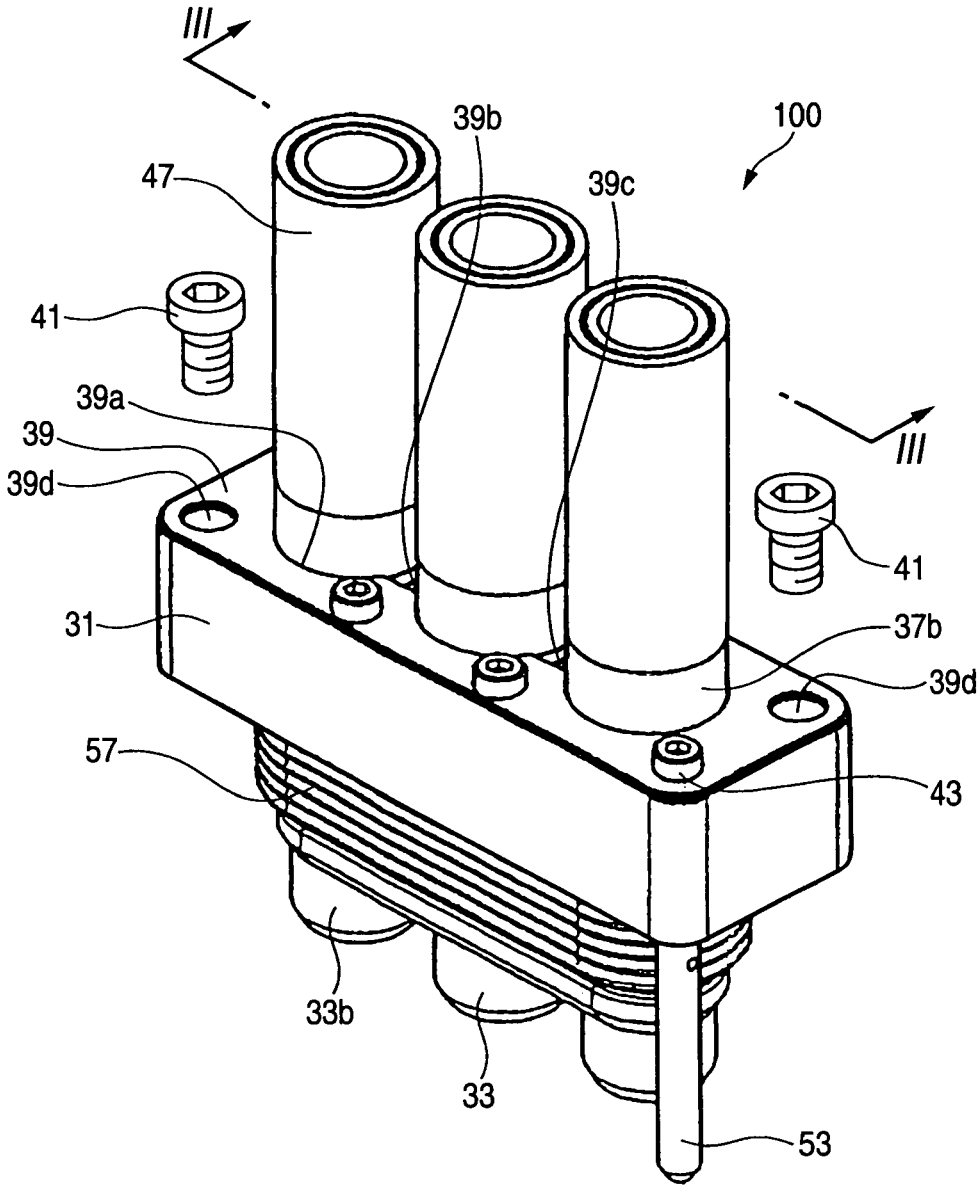
FIG. 1 is a perspective view of one preferred embodiment of a shield connector of the invention, showing its appearance.
Figure 2:
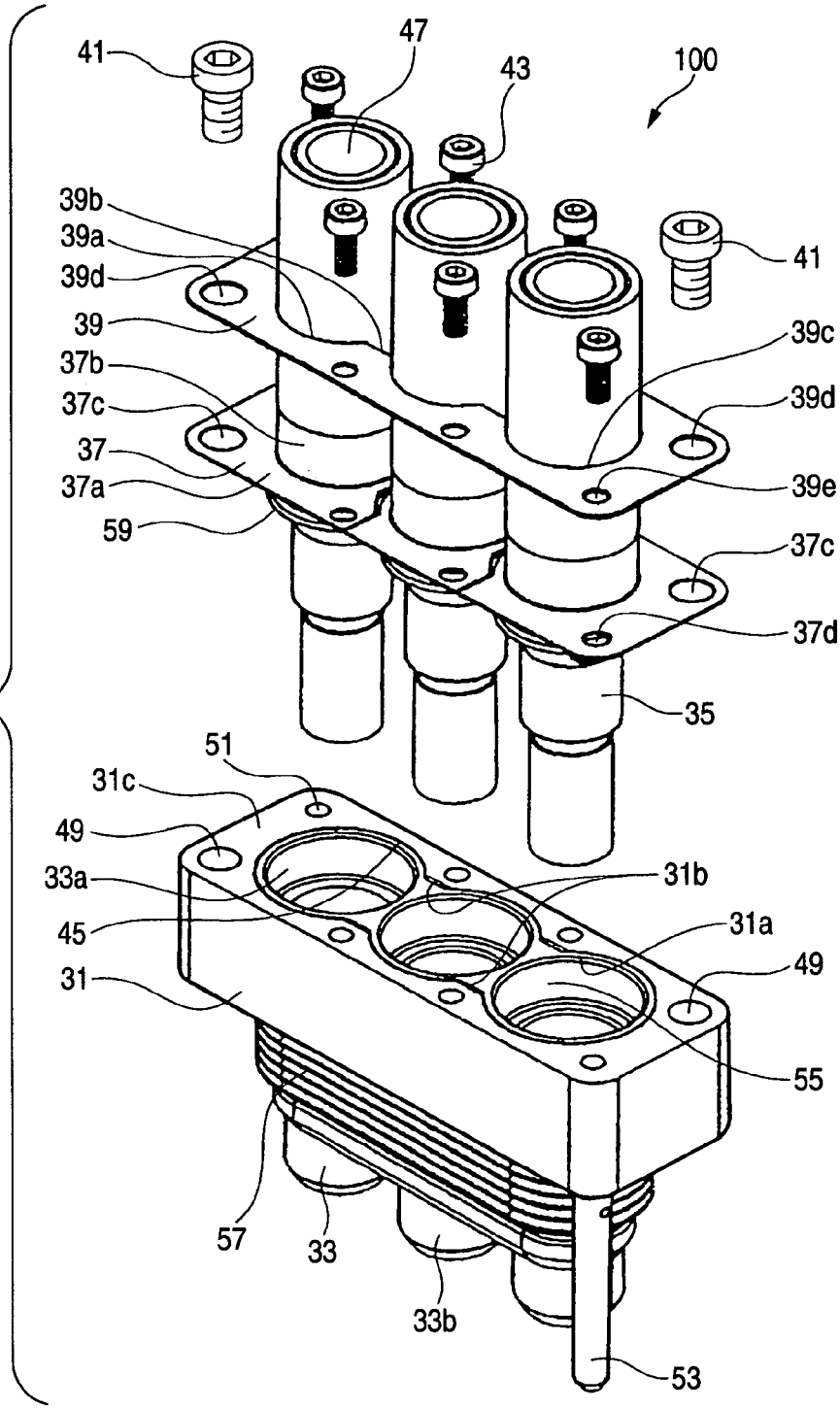
FIG. 2 is an exploded, perspective view of the shield connector of FIG. 1.
Figure 3:
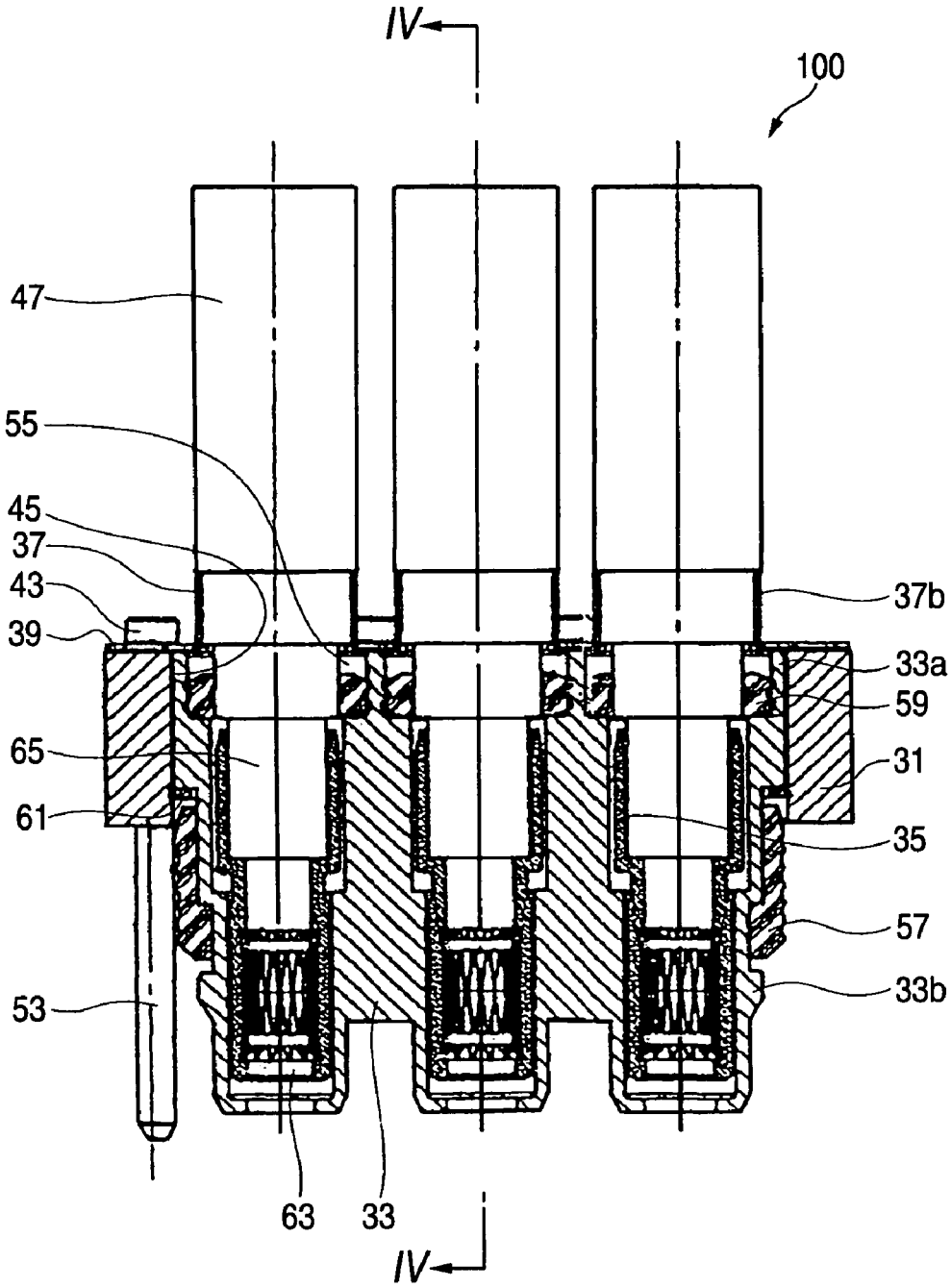
FIG. 3 is a vertical cross-sectional view taken along the line III—III of FIG. 1.
Figure 4:
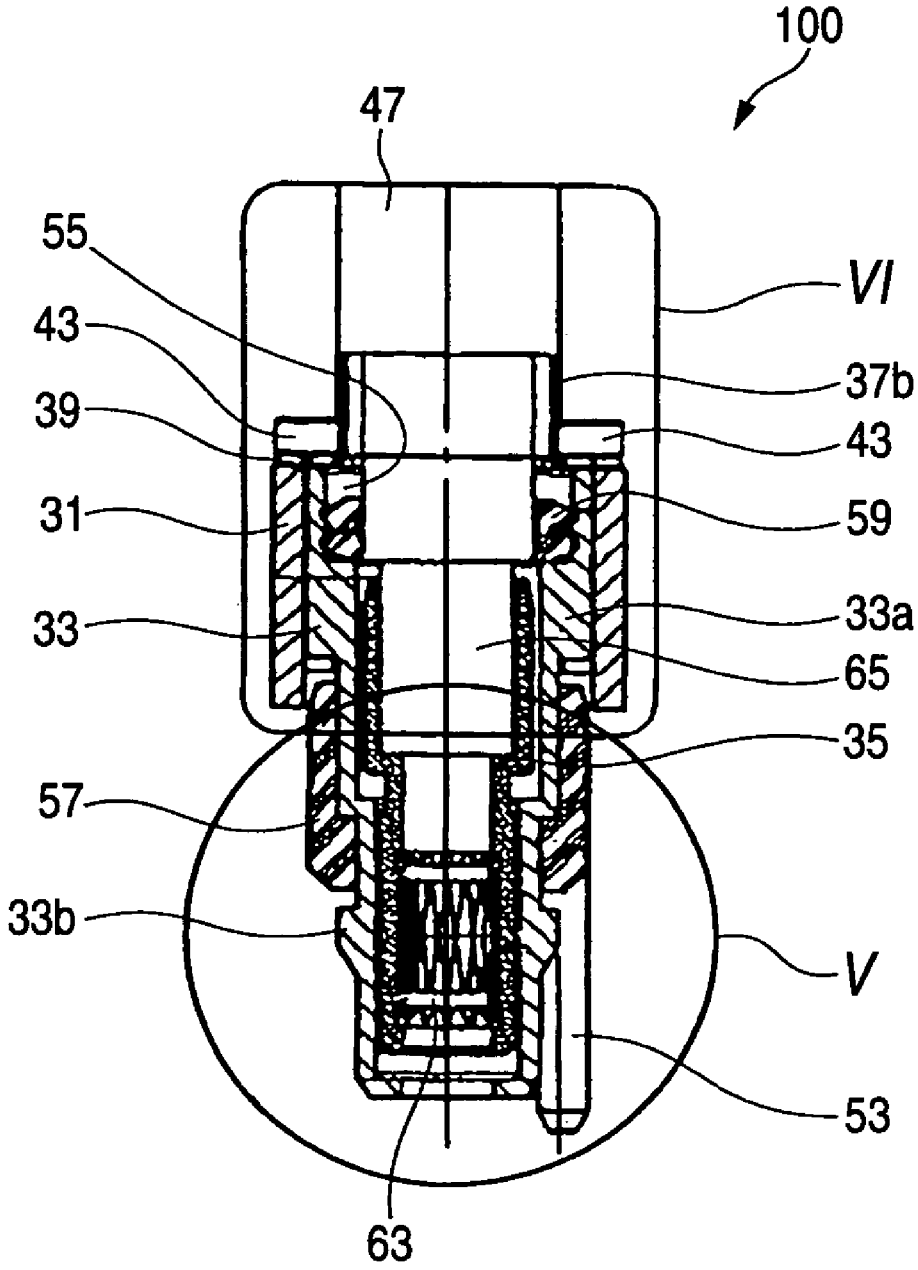
FIG. 4 is a vertical cross-sectional view taken along the line IV—IV of FIG. 3.
Figure 5:
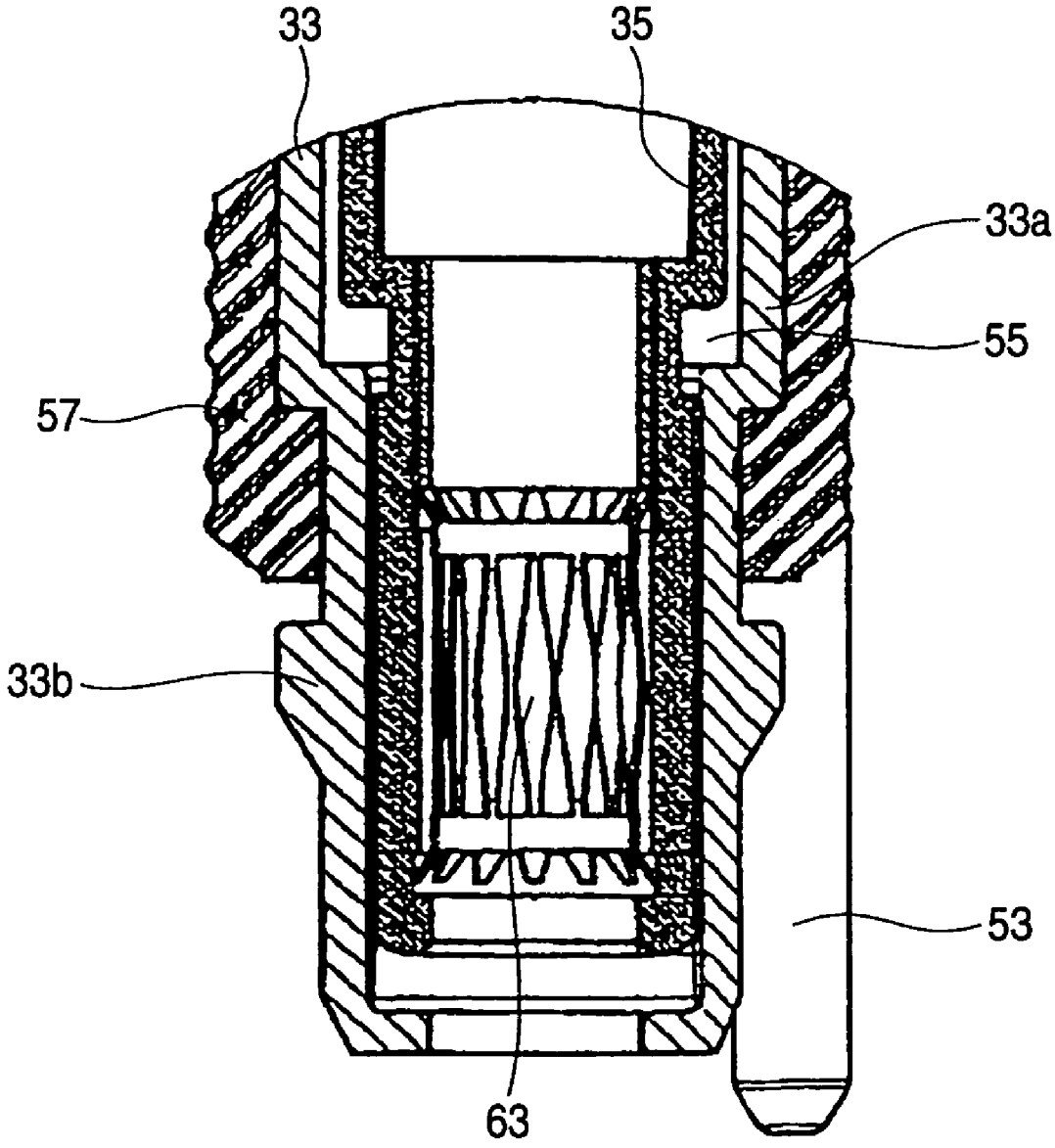
FIG. 5 is an enlarged view of a portion encircled by a circle V of FIG. 4.
Figure 6:
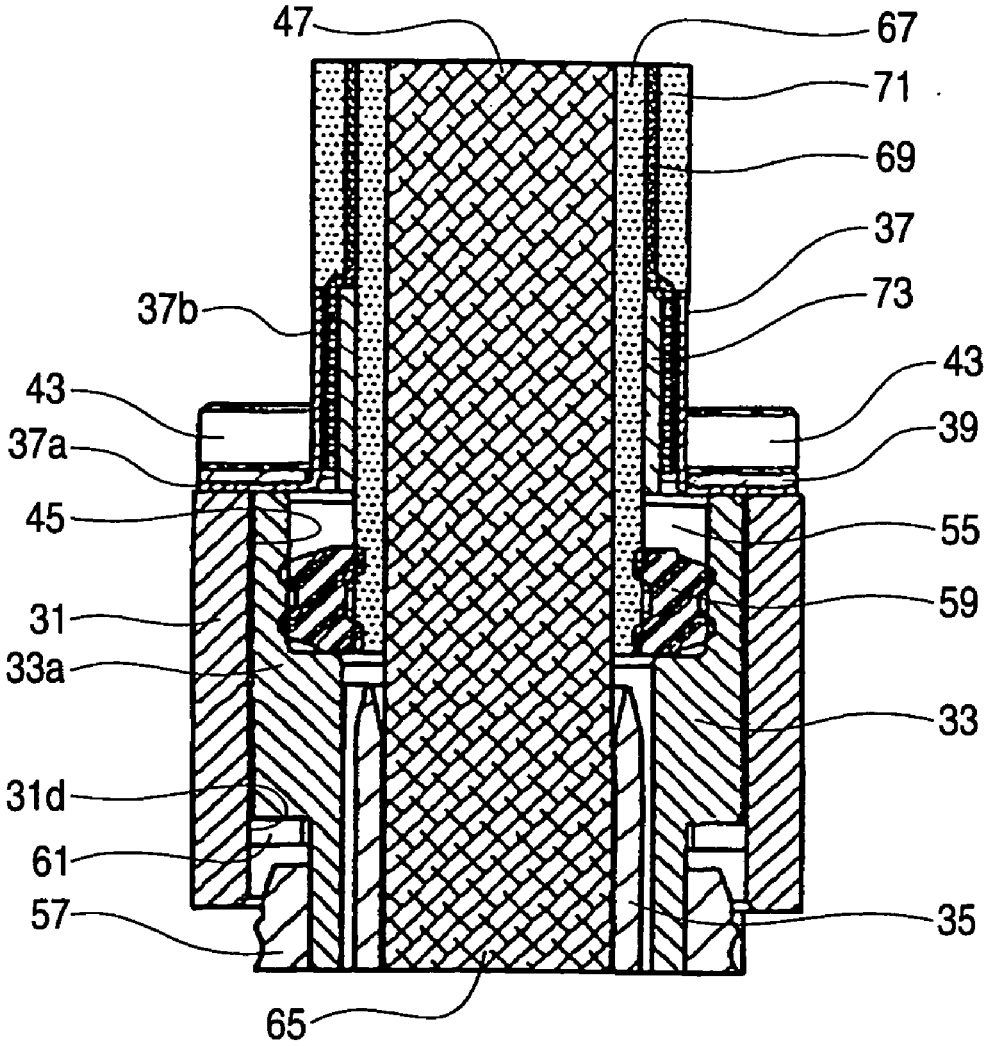
FIG. 6 is a an enlarged view of a portion enclosed by a rectangle VI of FIG. 4.
Figure 7:
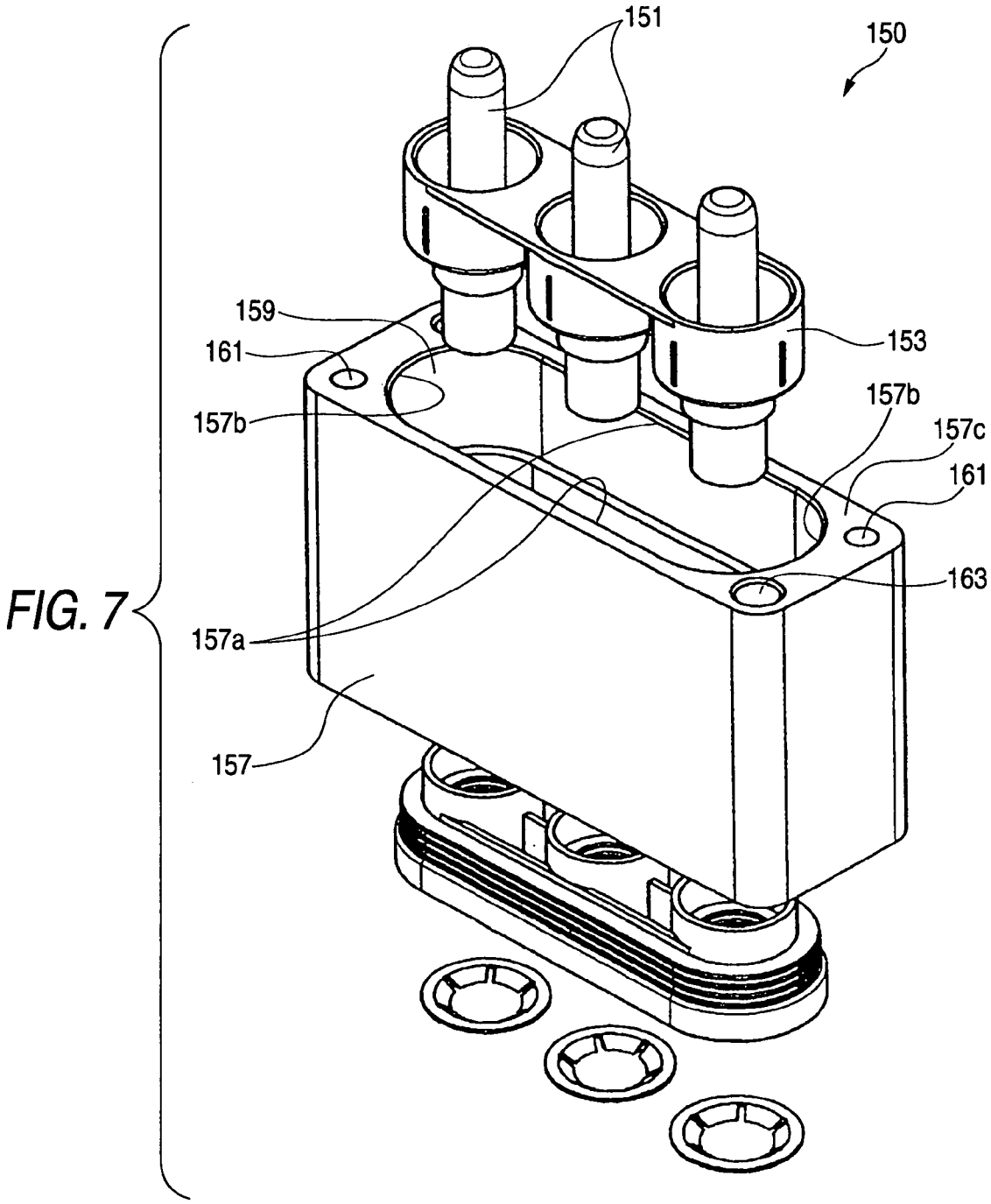
FIG. 7 is an exploded, perspective view of a mating connector.
Figure 8:
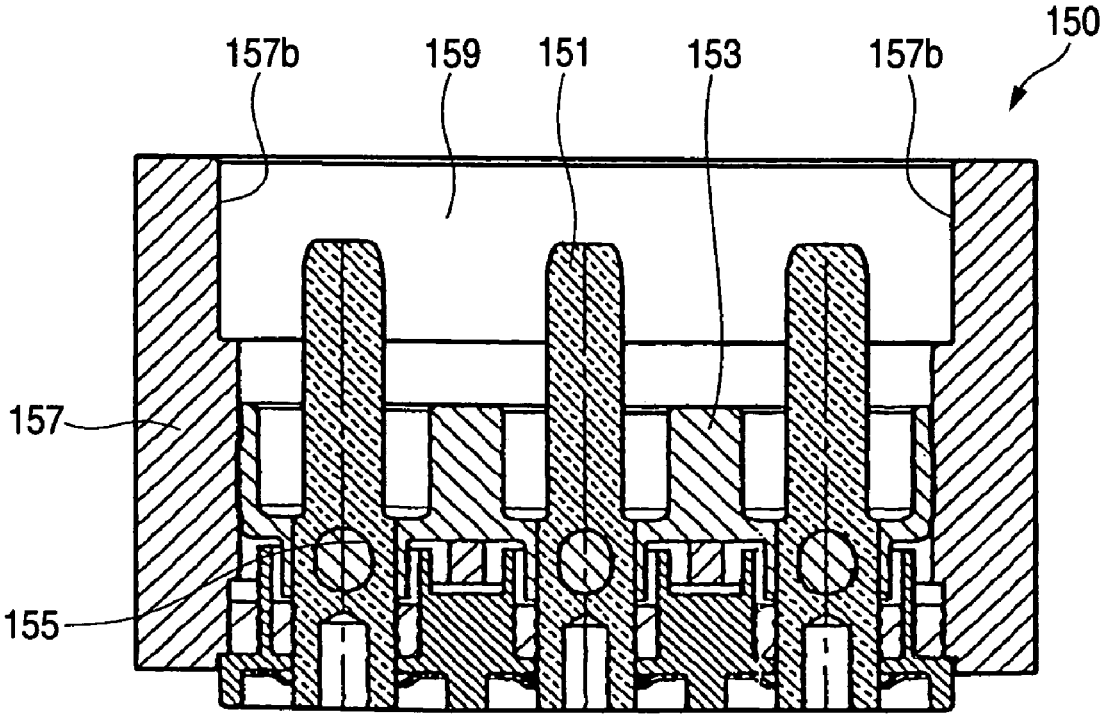
FIG. 8 is a vertical cross-sectional view of the mating connector of FIG. 7.
Figure 9:
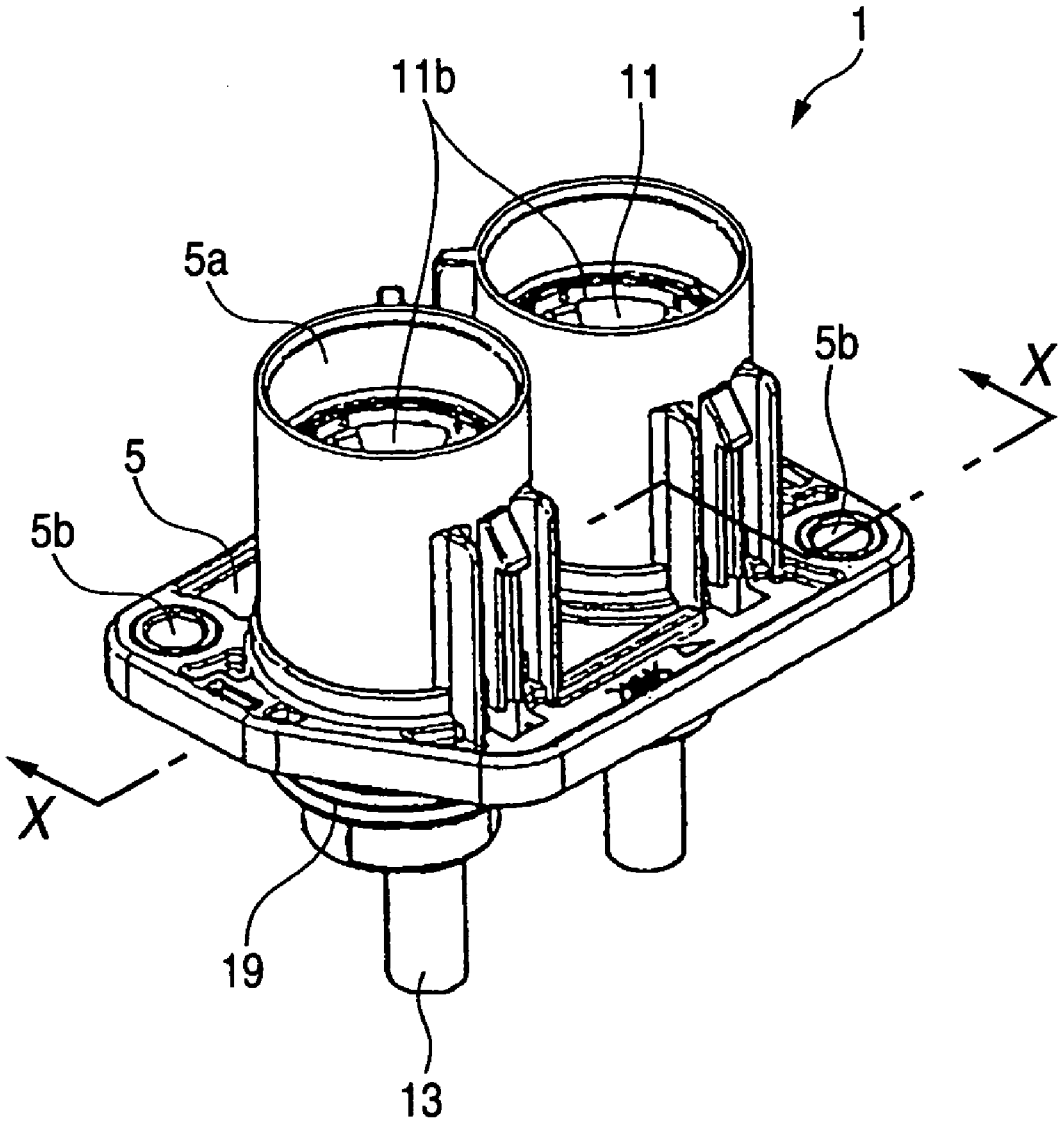
FIG. 9 is a perspective view of a related shield connector, showing its appearance.
Figure 10:
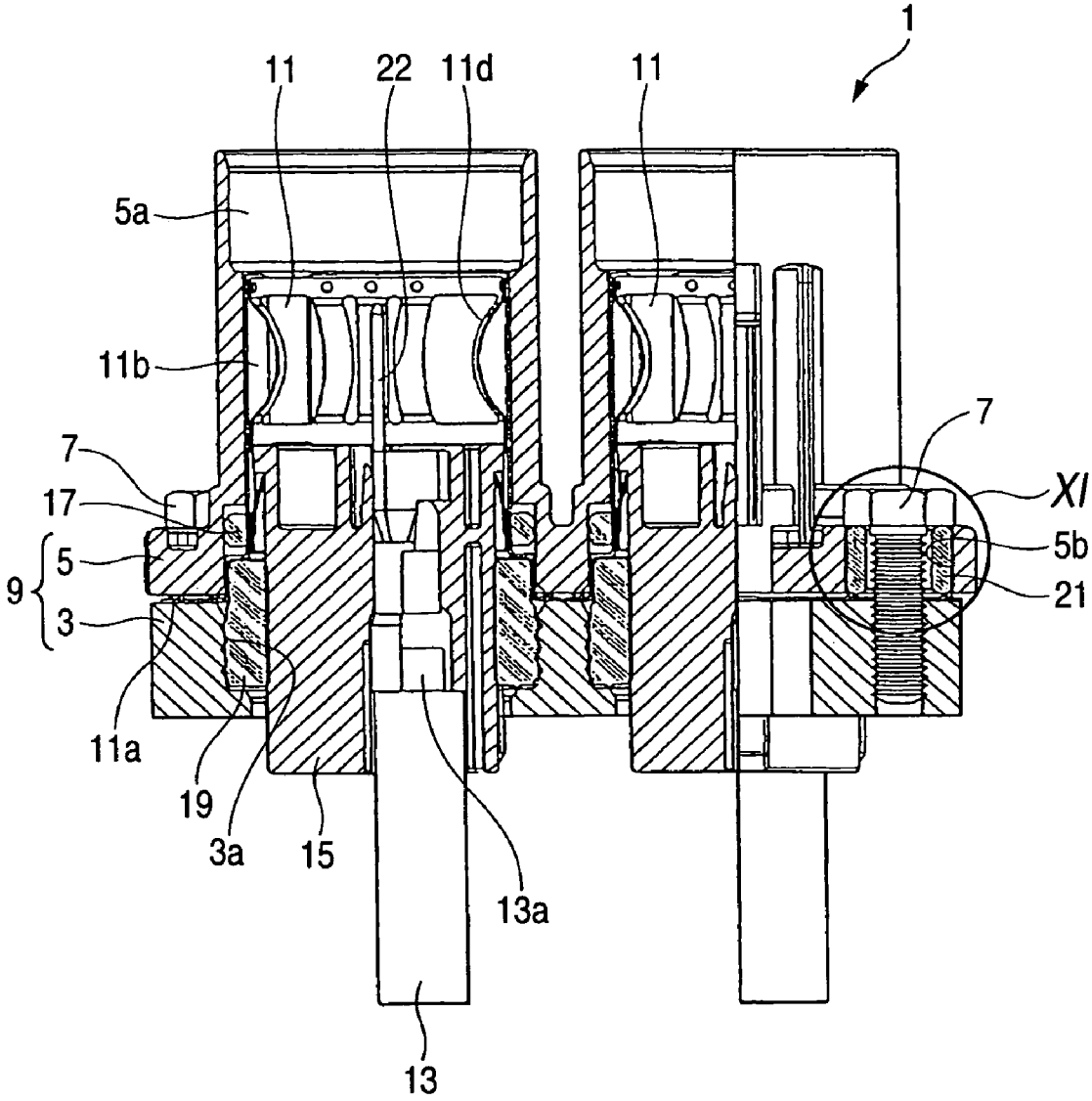
FIG. 10 is a vertical cross-sectional view taken along the line X—X of FIG. 9.
Figure 11:
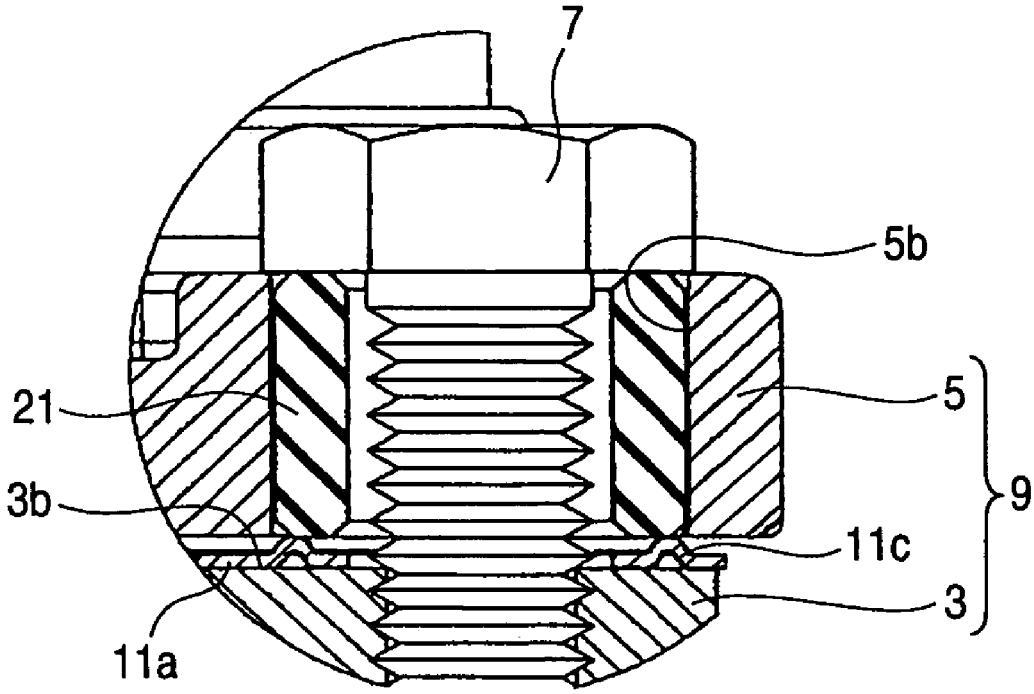
FIG. 11 is an enlarged view of a portion encircled by a circle X1 of FIG. 10.

FIG. 1 is a perspective view of one preferred embodiment of a shield connector of the invention, showing its appearance, FIG. 2 is an exploded, perspective view of the shield connector of FIG. 1, FIG. 3 is a vertical cross-sectional view taken along the line III—III of FIG. 1, FIG. 4 is a vertical cross-sectional view taken along the line IV—IV of FIG. 3, FIG. 5 is an enlarged view of a portion encircled by a circle V of FIG. 4, and FIG. 6 is a an enlarged view of a portion enclosed by a rectangle VI of FIG. 4. FIG. 7 is an exploded, perspective view of a mating connector, and FIG. 8 is a vertical cross-sectional view of the mating connector of FIG. 7.

Although the invention can be applied to both of male and female shield connectors, the illustrated embodiment of FIGS. 1 to 6 is directed to the type of shield connector in which three female pin terminals are mounted in a male connector housing. The number of the female pin terminals are not limited to three, and a desired number of female pin terminals can be used according to a need.

As shown in FIGS. 1 to 4, the shield connector 100 of this embodiment comprises the connector housing (male connector housing) 31, an inner housing 33, the terminals (female pin terminals) 35, shielding terminals 37, and a holder plate 39. In the shield connector 100, the inner housing 33, receiving the terminals 35, is fitted in a housing chamber 45 of the connector housing 31. The shielding terminals 37 are held between the connector housing 31 and the holder plate 39, and are fixed thereto by a plurality of bolts 41 and 43.

The connector housing 31 is made of an electrically-conductive material such for example as aluminum, and has a rectangular box-shape. The housing chamber 45 is formed in the connector housing 31, and extends therethrough in an upward-downward direction. In the illustrated embodiment, this housing chamber 45 is in the form of a generally triple-gourd-shaped hole having three circular edges 31*a* and two pairs of straight edges 31*b*, and each pair of straight edges 31*b* are parallel to a line interconnecting the centers of the adjacent circular edges 31*a*, and interconnect the adjacent circular edges 31*a*. For example, two internally-threaded portions 49 each having a screw thread of M5 and six internally-threaded portions 51 each having a screw thread of M3 are formed in an outer surface (upper surface in FIG. 1) 31*c* of the connector housing 31 from which shielded wires 47 are extended outwardly. Two positioning pins 53 project from an opposite outer surface (lower surface in FIG. 1), and are disposed on a diagonal line.

The inner housing 33 includes a body portion 33*a* of a generally triple-gourd-shape corresponding to the shape of the housing chamber 45, and three cylindrical portions 33*b* formed on and projecting from the body portion 33*a*. The inner housing 33 is made of an insulative resin such for example as PPS (polyphenylene-sulfite). The inner housing 33 has three independent terminal receiving chambers 55 defined respectively by through holes of a circular cross-section which extend through the body portion 33*a* and also through the respective cylindrical portions 33*b*. A ring-shaped (or annular) packing 57 which is made of acrylic rubber or the like is fitted or mounted on an outer peripheral surface of the body portion 33*a*. As shown in FIG. 6, the inner housing 33 is inserted in the housing chamber 45 of the connector housing 31, and is fixed to the connector housing 31 by C-rings 61, which are mounted respectively on the cylindrical portions 33*b*, engaged respectively in grooves 31*d* formed in the connector housing 31.

As shown in FIGS. 3 to 5, each of the terminals (female pin terminals) 35 is made of an electrically-conductive material such for example as nickel-plated copper, and is formed into a stepped hollow cylindrical shape. The terminals 35 are fitted respectively in the terminal receiving chambers 55 of the inner housing 33. A resilient contact piece 63 is fitted in a smaller-diameter portion of the terminal 35, and a conductor 65 of the shielded wire 47 is fixed to a larger-diameter portion of the terminal 35 by press-fastening, soldering or other means, and is electrically connected thereto.

As shown in FIG. 6, the shielded wire 47 includes the conductor 65 composed of a plurality of wire elements twisted together, an inner sheath 67 formed around the outer periphery of the conductor 65, an electrically-conductive shielding member 69 (made of an electrically-conductive material) formed around the outer periphery of the inner sheath 67, and an outer sheath 71 formed around the outer periphery of the shielding member 69. The outer sheath 71 and the shielding member 69 are removed over a suitable length from one end portion of the shielded wire 47, thereby exposing the inner sheath 67. A ring-shaped packing 59, made of self-lubricating silicone rubber or the like, is fitted on the outer periphery of the exposed inner sheath 67. The shielding member 69 is formed by using a braided wire, a spiral shielding wire, an aluminum foil, a copper foil and others alone or in combination.

As shown in FIGS. 2 and 6, the shielding terminal 37 is made of an electrically-conductive material such for example as nickel-plated copper, and includes a thin plate-shaped conducting plate portion 37*a*, and a cylindrical shielding shell 37*b* formed on and projecting upwardly from the plate portion 37*a*. A plurality of circular bolt holes 37*c* and 37*d* are formed through the plate portion 37*a*, and the bolts 41 and 43 are adapted to be passed through the bolt holes 37*c* and 37*d*, respectively. An inner diameter of the shielding shell 37*b* is slightly larger than an outer diameter of the shielding member 69 of the shielded wire 47. That portion of the shielded wire 47 at which the shielding member 69 is exposed by removing the outer sheath 71 over a predetermined length, passes through the shielding shell 37*b*. A cylindrical shielding sleeve 73, made of an electrically-conductive material, is inserted between the inner sheath 67 and the shielding member 69, and the shielding member 69 is held between the shielding shell 37*b* and the shielding sleeve 73. Therefore, the shielding shell 37*b* is electrically connected to the shielding member 69. Thus, the three shielding terminals 37, each having the shielding shell 37*b* to which the shielding member 69 is fixed and electrically connected, are disposed on the outer surface 31*c* of the connector housing 31.

As shown in FIGS. 1 and 2, the holder plate 39 is a plate-shaped member having generally the same outer shape as that of the outer surface 31*c* of the connector housing 31. Like the shielding terminals 37, the holder plate 39 is made of an electrically-conductive material. The holder plate 39 has a through hole 39*c* of a generally triple-gourd-shape which is defined by three circular edges 39*a* (each having a diameter slightly larger than the diameter of the shielding shell 37*b*) and two pairs of straight edges 39*b*, and each pair of straight edges 39*b* are parallel to a line interconnecting the centers of the adjacent circular edges 39*a*, and interconnect the adjacent circular edges 39*a*. Circular bolt holes 39*d* and 39*e*, corresponding respectively to the internally-threaded portions 49 and 51 of the connector housing 31, are formed through the holder plate 39. The holder plate 39 is much larger in thickness than the thin plate portion 37*a*, and has a larger mechanical strength as compared with the plate portion 37*a*.

The three shielding terminals 37 are placed on the outer surface 31*c* of the connector housing 31, with their shielding shells 37*b* passing through the through hole 39*c* formed in the holder plate 39, and their plate portions 37*a* are held between the connector housing 31 and the holder plate 39, and are fixed to the connector housing 31 by the plurality of bolts 41 and 43 threaded respectively into the internally-threaded portions 49 and 51. As a result, the plate portions 37*a* are held in contact with the outer surface 31*c* of the connector housing 31, and are electrically connected thereto.

Next, a procedure of assembling the shield connector 100 will be described.

As shown in FIGS. 2, 3 and 6, the inner housing 33 is inserted into the housing chamber 45 of the connector housing 31, and the C-rings 61, mounted respectively on the cylindrical portions 33*b*, are engaged respectively in the grooves 31*d* in the connector housing 31, thereby fixing the inner housing 33 to the connector housing 31. The packing 57 is fitted or mounted on the outer peripheral surface of the body portion 33*a*.

The outer sheath 71, the shielding member 69 and the inner sheath 67 are suitably removed from the one end portion of each shielded wire 47, thereby exposing the conductor 65 and the shielding member 69. Then, the shielded wires 47 are passed through the through hole 39*c* of a triple-gourd-shape in the holder plate 39, and further are passed respectively through the shield shells 37*b* of the shielding terminals 37. The exposed shielding member 69 of each shielded wire 47 is brought into opposed relation to the corresponding shielding shell 37*b*, and then the shielding sleeve 73 is inserted between the inner sheath 67 and the shielding member 69, and the shielding member 69 is held between the shielding shell 37*b* and the shielding sleeve 73, thereby electrically connecting the shielding shell 37*b* to the shielding member 69.

After the packing 59 is fitted on the inner sheath 67, the conductor 65 is inserted into the larger-diameter portion of the terminal (female pin terminal) 35, and the conductor 65 is fixed to the terminal 35 by press-fastening or soldering. Then, the terminals 35 are inserted respectively into the terminal receiving chambers 55 of the inner housing 33, and the plate portions 37*a* of the shielding terminals 37 are placed on the outer surface 31*c* of the connector housing 31. Then, the holder plate 39 is placed on the plate portions 37*a*, so that the plate portions 37*a* of the shielding terminals 37 are held between the outer surface 31*c* of the connector housing 31 and the holder plate 39. In this condition, the bolts 41 and 43 are threaded respectively into the internally-threaded portions 49 and 51, thereby fixing the holder plate 39 and the shielding terminals 37 to the connector housing 31.

The plate portion 37*a* of each shielding terminal 37 is pressed against the outer surface 31*c* of the connector housing 31 through the holder plate 39 having a high mechanical strength that is, flexural strength, and therefore any part of the plate portion 37*a* will not lift off the outer surface 31*c* of the connector housing 31, and therefore the plate portion 37 is positively held in contact with the outer surface 31*c* over the entire contact area thereof. In the case where the flexural strength of the holder plate 39 is sufficiently larger than that of each plate portion 37*a*, this fixing operation can be effected, using only the two bolts (larger bolts) 41 of M5. However, in order to positively achieve the shielding, it is preferred to additionally use the bolts (smaller bolts) of M3.

By effecting the above assembling operation, the shielding member 69 of each shielded wire 47 is electrically connected to the shielding shell 37*b* of the shielding terminal 37, and also the plate portion 37*a* of each shielding terminal 37 is held between the holder plate 39 and the outer surface 31*c* of the connector housing 31, and is electrically connected to the connector housing 31. As a result, the shielding member 69 of each shielded wire 47 is electrically connected to the connector housing 31, and the connector portion is shielded.

In the mating connector 150 for fitting connection to the shield connector 100, three terminals (male pin terminals) 151 are molded integrally in an inner housing 153 made of a synthetic resin. Each male pin terminal 151 has a through hole 151 of a circular cross-section formed therethrough in a diametrical direction. During the time when the male pin terminals 151 are molded integrally in the inner housing 153, part of a synthetic resin flows into the through hole 155 in each male pin terminal 151, so that the male pin terminals 151 are positively fixed to the inner housing 153. A connector housing (female connector housing) 157 is made of an electrically-conductive material such as aluminum, and has a generally rectangular box-shape. A fitting hole 159 of a generally oval cross-section is formed through the connector housing 157, and is defined by straight opposed side surfaces 157*a* (extending respectively along longer sides of the connector housing) and generally semi-circular opposite end surfaces 157*b* (extending respectively along shorter sides of the connector housing). The inner housing 153, having the male pin terminals 151 integrally molded therein, is inserted in the fitting hole 159, and is fixed thereto. Positioning holes 161 of a circular shape are formed in one end surface 157*c* of the connector housing 157, and are disposed on a diagonal line of the fitting hole 159, and also internally-threaded portions 163 are formed in the one end surface 157*c*, and are disposed on another diagonal line of the fitting hole 159.

The male pin terminals 151 in the mating connector 150 are fitted respectively into the resilient contact pieces 63 fitted respectively in the terminals (female pin terminals) 35 in the shield connector 100, while fitting the positioning pins 53 into the positioning holes 161 in the mating connector 150, and the outer surface 31*c* of the connector housing 31 of the shield connector 100 and the end surface 157*c* of the mating connector housing 157 of the mating connector 150 are brought into contact with each other, and the two connector housings are fixed to each other. As a result, the female pin terminals 35 are electrically connected respectively to the male pin terminals 151 in such a manner that the connector portion is shielded.

The construction of the shield connector 100 of the above embodiment will be briefly described below.

The shield connector 100 includes:

the connector housing 31 which is made of the electrically-conductive material, and has the housing chamber 45;

the inner housing 33 which is made of the insulative material, and is fitted in the housing chamber 45;

the plurality of terminal receiving chambers 55 formed in the inner housing 33;

the plurality of terminals 35 received respectively in the plurality of terminal receiving chambers 55;

the plurality of shielding terminals 37 each of which is formed into an integral construction, using the electrically-conductive material, each of the shielding terminals including the plate-shaped conducting plate portion 37*a* disposed on the outer surface 31*c* of the connector housing 31, and the shielding shell 37*b* of a tubular shape formed in an upstanding manner on the conducting plate portion;

the single holder plate 39 which has the through hole 39*c* through which the shielding shells 38*b* of the plurality of shielding terminals pass, and presses the conducting plate portions 37*a* of the plurality of shielding terminals against the outer surface 31*c* of the connector housing 31, so that the plurality of conducting plate portions 37*a* are held between the holder plate 39 and the outer surface 31*c* of the connector housing 31; and the plurality of shielded wires 47 having electrically-conductive shielding members 69, respectively, which are in contact with the shielding shells 37*b* of the plurality of shielding terminals, respectively; and the shielding members 69 of the plurality of shielded wires 47 are electrically connected to the connector housing 31, thereby achieving the shielding.

In the shield connector 100 of the construction, each of the plurality of the shielding terminals 37 includes the plate-shaped conducting plate portion 37*a*, and the shielding shell 37*b* of a tubular shape which is formed in an upstanding manner on the plate portion 37*a*, the shielding shells 37*b* of these shielding terminals being electrically connected respectively to the shielding members 69 of the plurality of shielded wires 47. The plate portions 37*a* of the plurality of shielding terminals 37 are held between the single holder plate 39 and the outer surface 31*c* of the connector housing 31, and are disposed on the outer surface 31*c* of the connector housing 31. These plate portions 37*a* are fixed to the connector housing 31 by the fastening means such as the bolts 41 and 43. With this construction, the plurality of conducting plate portions 37*a* are pressed against the outer surface 31*c* of the connector housing 31 by the holder plate 39 of a high mechanical strength, and therefore are positively held in surface-to-surface contact with the outer surface 31*c* of the connector housing 31, so that the effective area of contact between each conducting plate portion 37*a* and the outer surface 31*c* of the connector housing 31 increases. Therefore, the contacting ability of each shielding terminal 37 is enhanced, so that the shielding member 69 of each shielded wire 47 is positively electrically connected to the connector housing 31, and the conductors 65 of the shielded wires 47, as well as the terminals 35 electrically connected respectively to these conductors 65, are positively shielded from external noises.

The present invention is not limited to the above embodiment, and suitable modifications, improvement and so on can be made. The material, shape, numeral value, form, number, disposition, etc., of each of the constituent elements of the above embodiment are arbitrary, and are not limited in so far as the invention can be achieved.

Although the above embodiment is directed to the shield connector in which the female terminals (female pin terminals) are mounted in the male connector housing, the invention is not limited to this embodiment, and can be applied to the type of shield connector in which male terminals are mounted in a female connector housing.

In the shield connector of the above embodiment, the number of each of the terminal receiving chambers, the terminals, the shielding terminals (each having the conducting plate portion and the shielding shell) and the shielded wires (each having the electrically-conductive shielding member) among the constituent elements is plural. However, even in the case where the number of each of the constituent elements of the shield connector is one, excellent operations and advantages are similarly achieved.

What is claimed is:

1. A shield connector comprising:

a conductive connector housing;

a shielded wire extended from the connector housing and comprising:

a conductor adapted to be electrically connected to a mating terminal;

an insulative sheath covering the conductor; and a conductive shielding member covering the sheath;

a conductive shielding terminal comprising:

a first plate disposed on the connector housing and having a first through hole through which the shielded wire passes and a contact portion which is in contact with the shielding member;

a conductive second plate having a second through hole through which the shielded wire passes; and a plurality of fixing members fixing the first plate and the second plate on the connector housing, such that the first plate is pressed by the second plate against the connector housing.

2. A shield connector according to claim 1, wherein the first plate has a first stiffness, and the second plate has a second stiffness that is lager than the first stiffness.

3. A shield connector according to claim 2, wherein the first plate has a first thickness, and the second plate has a second thickness that is lager than the first thickness.

4. A shield connector according to claim 1, wherein the contact portion has a tubular shape surrounding the shielding member.

* * * * *